US012018866B2

(12) United States Patent
Wong

(10) Patent No.: US 12,018,866 B2
(45) Date of Patent: Jun. 25, 2024

(54) CENTRAL AIR CONDITIONING AND HEAT PUMP SYSTEM WITH COOLING ARRANGEMENT

(71) Applicant: Lee Wa Wong, Alhambra, CA (US)

(72) Inventor: Lee Wa Wong, Alhambra, CA (US)

( * ) Notice: Subject to any disclaimer, the term of this patent is extended or adjusted under 35 U.S.C. 154(b) by 0 days.

(21) Appl. No.: 18/264,152

(22) PCT Filed: Feb. 4, 2021

(86) PCT No.: PCT/US2021/016684

§ 371 (c)(1),
(2) Date: Aug. 3, 2023

(87) PCT Pub. No.: WO2022/169454

PCT Pub. Date: Aug. 11, 2022

(65) Prior Publication Data

US 2024/0035716 A1 Feb. 1, 2024

(51) Int. Cl.
*F25B 30/02* (2006.01)
*F25B 41/20* (2021.01)

(52) U.S. Cl.
CPC ..... *F25B 30/02* (2013.01); *F25B 41/20* (2021.01)

(58) Field of Classification Search
CPC ..... F25B 30/02; F25B 25/005; F25B 29/003; F25B 29/2313; F25B 29/00; F25B 2313/003; F25B 2313/004; F25B 2313/02731; F25B 2313/02742; F25B 2400/00; F25B 2400/05
See application file for complete search history.

(56) References Cited

U.S. PATENT DOCUMENTS

| | | | | |
|---|---|---|---|---|
| 3,938,352 | A | 2/1976 | Schmidt | |
| 6,041,613 | A | 3/2000 | Morse et al. | |
| 2016/0091215 | A1 | 3/2016 | Wong | |
| 2018/0128506 | A1 | 5/2018 | Taras et al. | |
| 2021/0095872 | A1* | 4/2021 | Taras | F25B 13/00 |

* cited by examiner

*Primary Examiner* — Elizabeth J Martin
(74) *Attorney, Agent, or Firm* — Tsz Lung Yeung

(57) ABSTRACT

A central air conditioning and heat pump system includes a main heat exchange system and a cooling arrangement. The main heat exchange system includes a compressor, a first heat exchanger, a second heat exchanger. The cooling arrangement includes a cooling tower and a cooling heat exchanger. When the central air conditioning and heat pump system is selectively operated in a comprehensive air conditioning mode, refrigerant may be cooled both by water and ambient air in the cooling arrangement and the second heat exchanger respectively.

17 Claims, 5 Drawing Sheets

CENTRAL AIR CONDITIONING AND HEAT PUMP SYSTEM WITH COOLING ARRANGEMENT

BACKGROUND OF THE PRESENT INVENTION

Field of Invention

The present invention relates to a central air conditioning and heat pump system which is capable of saving a substantial amount of energy when the central air conditioning and heat pump system is being operated in a heat pump mode.

Description of Related Arts

Conventional air conditioning and heat pump systems may be broadly divided into two main types. The first type is air conditioning and heat pump systems which are arranged to directly heat up or cool down the air of an indoor space. An example of the first type is window-type air conditioning and/or heat pump units, which controllably suck air from the indoor space and directly heat up or cool down the air. After the air has been heated or cooled, it is delivered back to the indoor space.

The second type is central air conditioning heat pump systems in which a heat exchange medium (usually water) may be used to heat up or cool down the air in the indoor space. Referring to FIG. 1 to FIG. 5 of the drawings, the central air conditioning and heat pump system comprises a main heat exchange system 10P and a heat delivery system 20P. The main heat exchange system 10P comprises an outer casing 11P, a compressor 12P, at least one heat exchanger 13P, a gas-liquid heat exchanging device 14P, and a fan assembly 15P. The main heat exchange system 10P is usually installed on a roof of a building so that it may absorb heat from or discharge heat to ambient air. A predetermined amount of refrigerant may circulate through the compressor 12P, the heat exchanger 13P, the gas-liquid heat exchanging device 14P and other components for carrying out several heat exchanging processes.

On the other hand, the heat delivery system 20P comprises a water pump 21P and a water pipeline system 22P connected to the water pump 21P. The water pipeline system 22P is configured to transport water to different designated indoor spaces in the building. The water circulating in the heat delivery system 20P is arranged to perform heat exchange with the refrigerant in the gas-liquid heat exchanging device 14P of the main heat exchange system 10P. Furthermore, the heat delivery system 20P may further comprise a fresh air supplying device 23P connected to the water pipeline system 22P. As shown in FIG. 5 of the drawings, the fresh air supplying device 23P usually comprises a supporting frame 231P, a centrifugal fan 232P received in the supporting frame 231P, and a fresh air heat exchanger 233P also received in the supporting frame 231P. The supporting frame 231P has an air inlet 2311P, wherein ambient air may be drawn into the fresh air supplying device 23P through the air inlet 2311P.

The refrigerant circulating in the main heat exchange system 10 is arranged to absorb heat from ambient air and release heat to the water circulating through the gas-liquid heat exchanging device 14P. The water having absorbed heat from the refrigerant is then pumped to various terminal devices such as the fresh air supplying device 23P. The purpose of the terminal devices is to regulate and ventilate air to and from a designated indoor space. Within a heat delivery system 20P, there may exist a number of terminal devices which may include the above-mentioned fresh air supplying device 23P, or other air handlers.

The water delivered to the fresh air supplying device 23P is arranged to carry out heat exchange with the ambient air in the fresh air heat exchanger 233P. The water is arranged to release heat to the air. The heated air may be transported to the designated indoor space for supplying fresh air to the indoor environment. The heating of the ambient air is essential because the temperature of the ambient air is usually very low and that is the very reason why the central air conditioning heat pump system is used to generate heat in the indoor space.

Although the above-mentioned air conditioning and heat pump systems have widely been utilized around the world for many years, these systems suffer a common deficiency of a relatively low Coefficient of Performance (COP), which may be defined as a ratio of heat supplied to or removed from a reservoir to the work required.

Accordingly, there is a need to develop an air conditioning and heat pump system which has substantially improved COP.

SUMMARY OF THE PRESENT INVENTION

Certain variations of the present invention provide an air conditioning and heat pump system which is capable of saving a substantial amount of energy when the air conditioning and heat pump system is being operated.

Certain variations of the present invention provide an air conditioning and heat pump system which may selectively utilize cooling water in a cooling tower to cool down the temperature of the refrigerant when the air conditioning and heat pump system is being operated in a comprehensive air conditioning mode.

Certain variations of the present invention provide an air conditioning and heat pump system which may allow refrigerant to be cooled by either heat exchangers (air-cooled) or a cooling tower (water-cooled), or both.

Certain variations of the present invention provide an air conditioning and heat pump system which is capable of producing more heat to designated indoor space for a given work done by the system as compared with conventional air conditioning and heat pump system as described above.

In one aspect of the present invention, the present invention provides a central air conditioning and heat pump system for a heat distribution system, comprising:

- a plurality of connecting pipes;
- a main heat exchange system, which comprises:
  - a compressor having a compressor outlet and a compressor inlet;
  - a first heat exchanger connected to the compressor through at least one of the connecting pipes; and
  - a second heat exchanger connected to the compressor and the first heat exchanger through at least one of the connecting pipes;
- a refrigerant storage tank; and
- a cooling arrangement, which comprises:
- a cooling tower, which comprises:
  - a tower casing having a cooling tower air inlet and a cooling tower air outlet;
  - a fan provided in a vicinity of the cooling tower air outlet;
  - a water storage tank provided in the tower casing for storing a predetermined amount of cooling water;
  - a water distributor provided in the tower casing and connected to the water storage tank through at least one of the connecting pipes, the water distributor comprising at least one spraying head arranged to spray water at a predetermined direction, a pump connected between the water storage tank and the water distributor so that the cooling water in the water storage tank is arranged to be pumped to the water distributor through the pump; and a cooling heat exchanger provided in the tower casing and connected to the second heat exchanger, the first heat exchanger, and the refrigerant storage tank through at least one of the connecting pipes, the water distributor being arranged to spray the cooling water on the cooling heat exchanger so that refrigerant passing through the cooling heat exchanger is allowed to perform heat exchange with the cooling water;

the air conditioning and heat pump system being selectively operated between a comprehensive air conditioning mode and a heat pump mode, wherein in the comprehensive air conditioning mode, a predetermined amount of vaporous refrigerant is arranged to leave the compressor and guided to enter the second heat exchanger for releasing heat thereto, the refrigerant leaving the second heat exchanger being guided to flow into the cooling heat exchanger for further releasing a predetermined amount of heat to the water circulating in the cooling arrangement, the refrigerant leaving the cooling heat exchanger being guided to flow through the first heat exchanger for absorbing heat from the heat distribution system, the refrigerant leaving the first heat exchanger being guided to flow back to the compressor to complete an air conditioning cycle, wherein in the heat pump mode, a predetermined amount of vaporous refrigerant is arranged to leave the compressor and guided to flow into the first heat exchanger for releasing heat to the heat distribution system, the refrigerant leaving the first heat exchanger being guided to flow into the refrigerant storage tank for being temporarily stored, the refrigerant leaving the refrigerant storage tank being guided to flow to the second heat exchanger for absorbing heat from ambient air, the refrigerant leaving the second heat exchanger being guided to flow back to the compressor to complete a heat pump cycle.

DETAILED DESCRIPTION OF THE PREFERRED EMBODIMENT

The following detailed description of the preferred embodiment is the preferred mode of carrying out the invention. The description is not to be taken in any limiting sense. It is presented for the purpose of illustrating the general principles of the present invention.

It should be appreciated that the terms "install", "connect", "couple", and "mount" in the following description refer to the connecting relationship in the accompanying drawings for easy understanding of the present invention. For example, the connection can refer to permanent connection or detachable connection. Furthermore, "connected" may also mean direct connection or indirect connection, or connection through other auxiliary components. Therefore, the above terms should not be an actual connection limitation of the elements of the present invention.

It should be appreciated that the terms "length", "width", "top", "bottom", "front", "rear", "left", "right", vertical", "horizontal", "upper", "lower", "exterior", and "interior" in the following description refer to the orientation or positioning relationship in the accompanying drawings for easy understanding of the present invention without limiting the actual location or orientation of the present invention. Therefore, the above terms should not be an actual location limitation of the elements of the present invention.

It should be appreciated that the terms "first", "second", "one", "a", and "an" in the following description refer to "at least one" or "one or more" in the embodiment.

In particular, the term "a" in one embodiment may refer to "one" while in another embodiment may refer to "more than one". Therefore, the above terms should not be an actual numerical limitation of the elements of the present invention.

Figure 1:
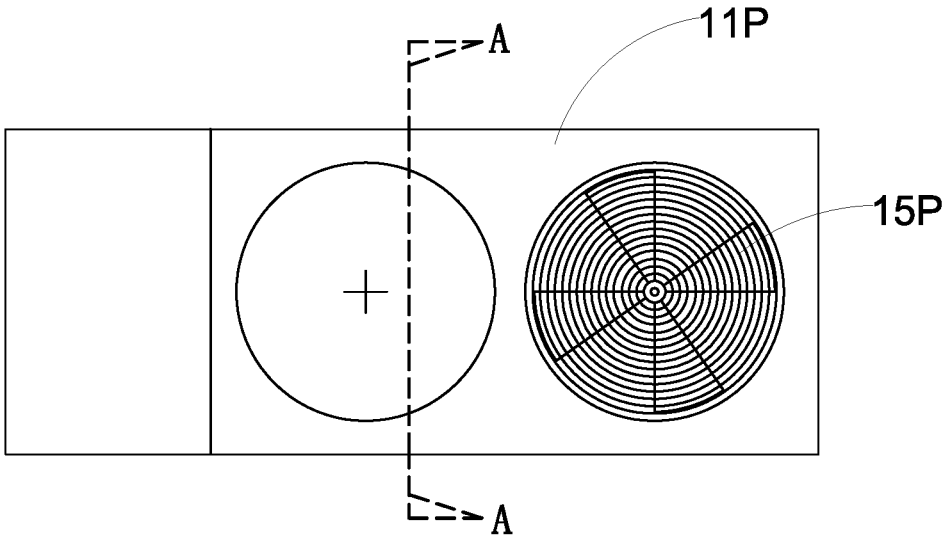
FIG 1 PRIOR ART
FIG. 1 is a top view of a main casing of a conventional central air conditioning and heat pump system.
Figure 2:
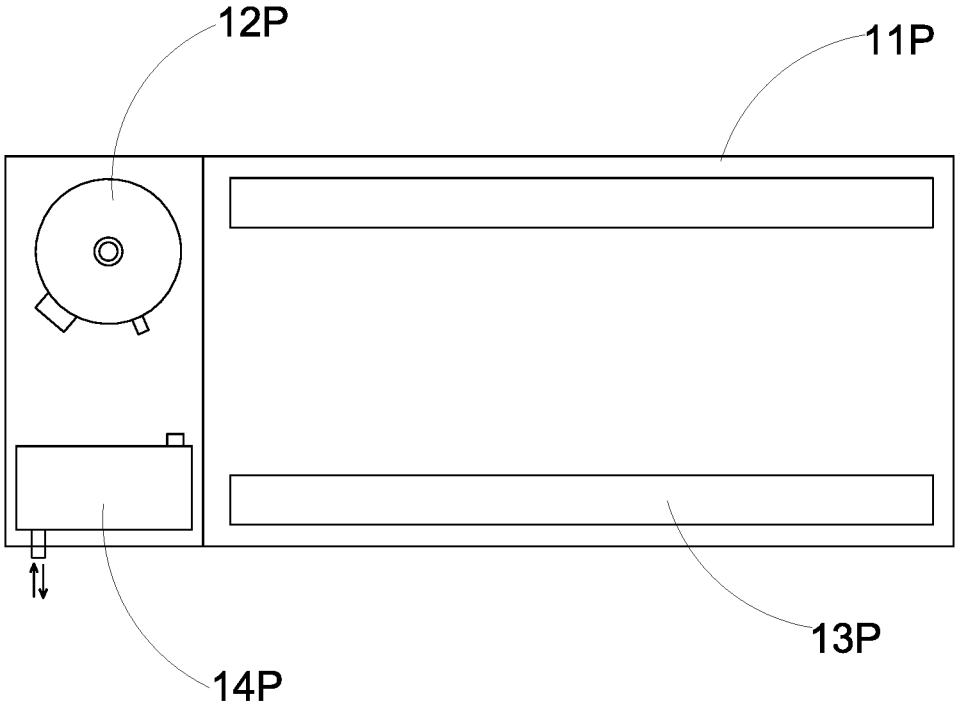
FIG 2 PRIOR ART
FIG. 2 is sectional top view of the main casing of the conventional central air conditioning and heat pump system.
Figure 3:
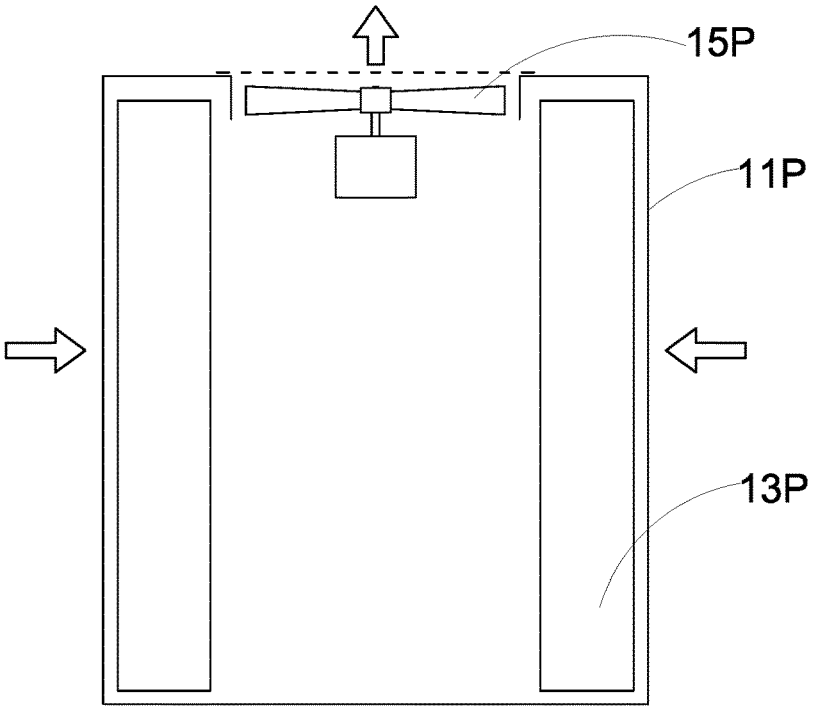
FIG 3 PRIOR ART
FIG. 3 is sectional side view of the main casing of the conventional central air conditioning and heat pump system along plane A-A of FIG. 1.
Figure 4:
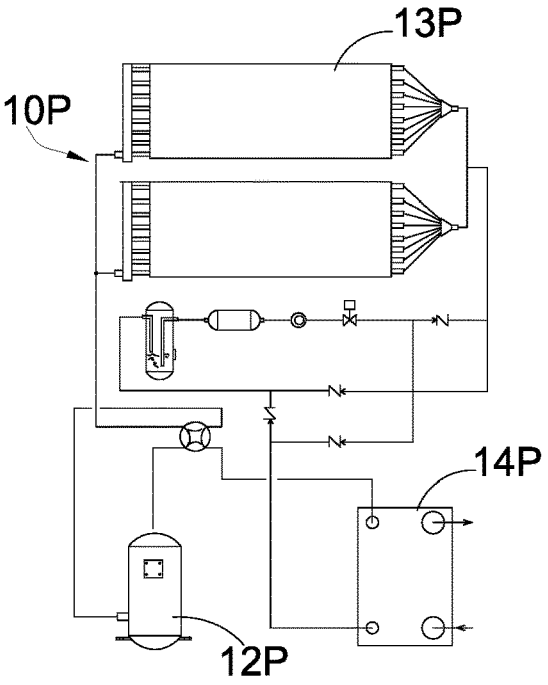
FIG 4 PRIOR ART
FIG. 4 is schematic diagram of a main heat exchange system of a conventional central air conditioning and heat pump system.
Figure 5:
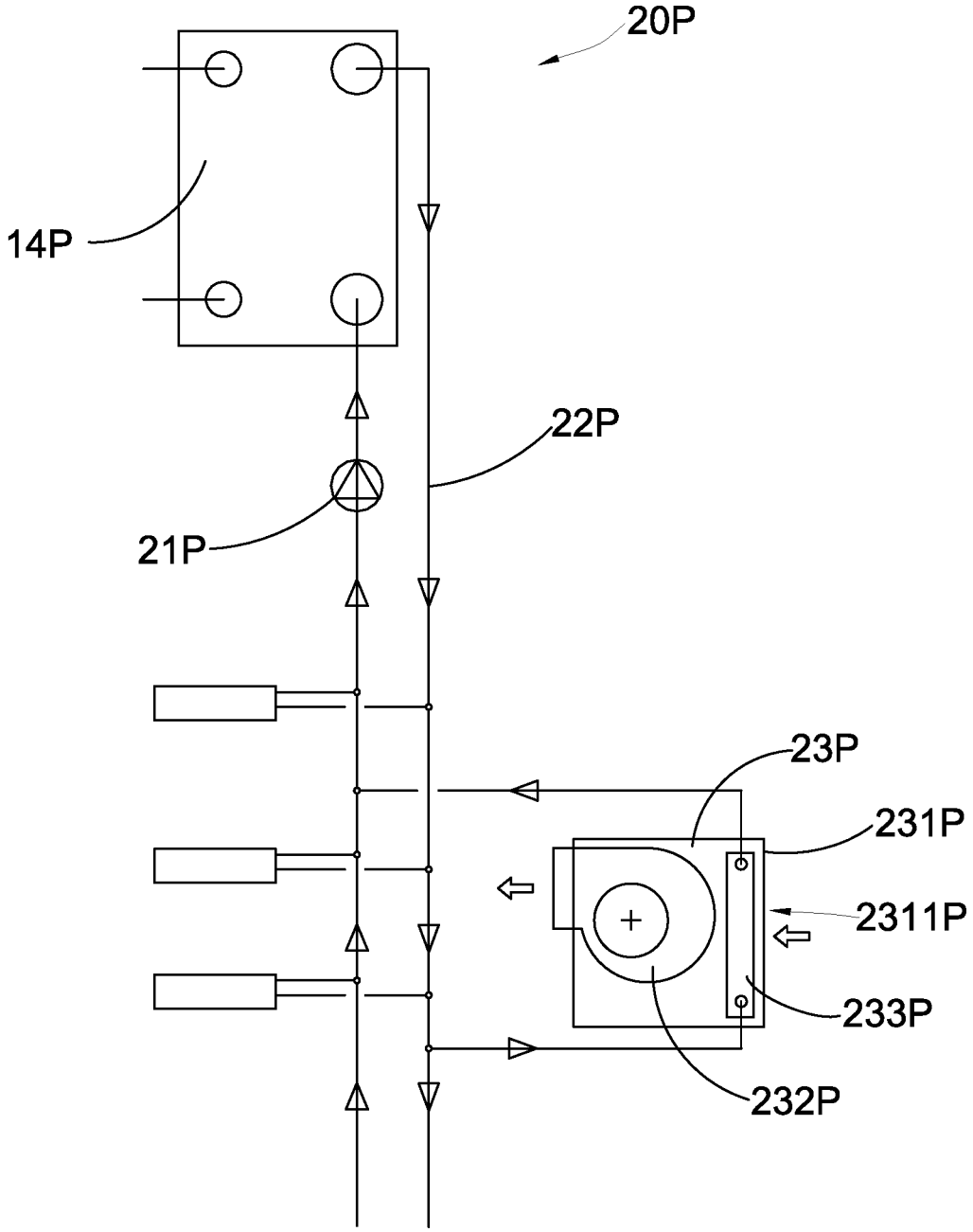
FIG 5 PRIOR ART
FIG. 5 is schematic diagram of a heat delivery system of a conventional central air conditioning and heat pump system.
Figure 6:
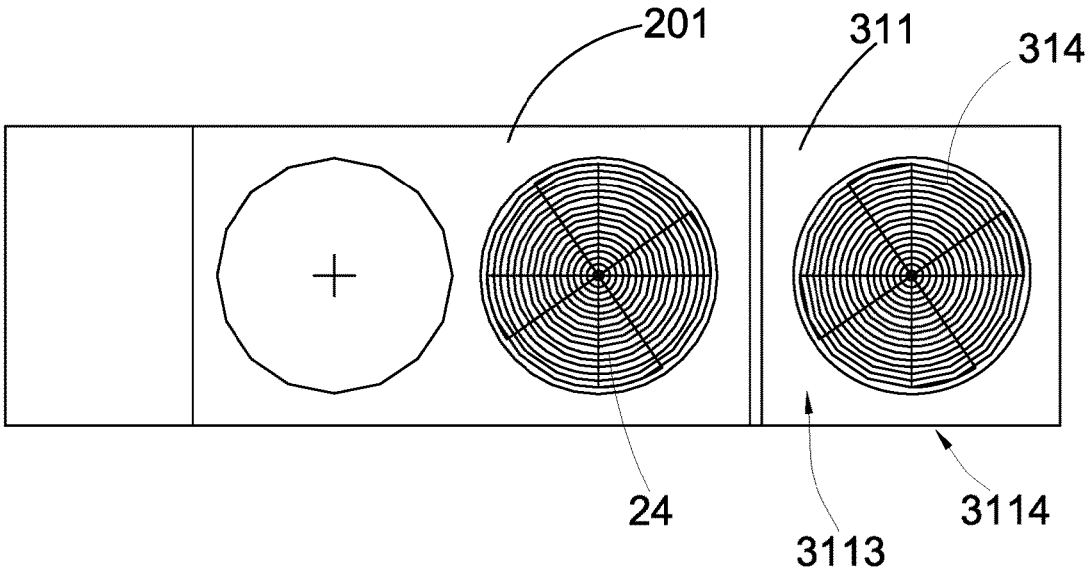
FIG. 6 is a top view of a central air conditioning and heat pump system according to a preferred embodiment of the present invention.
Figure 7:
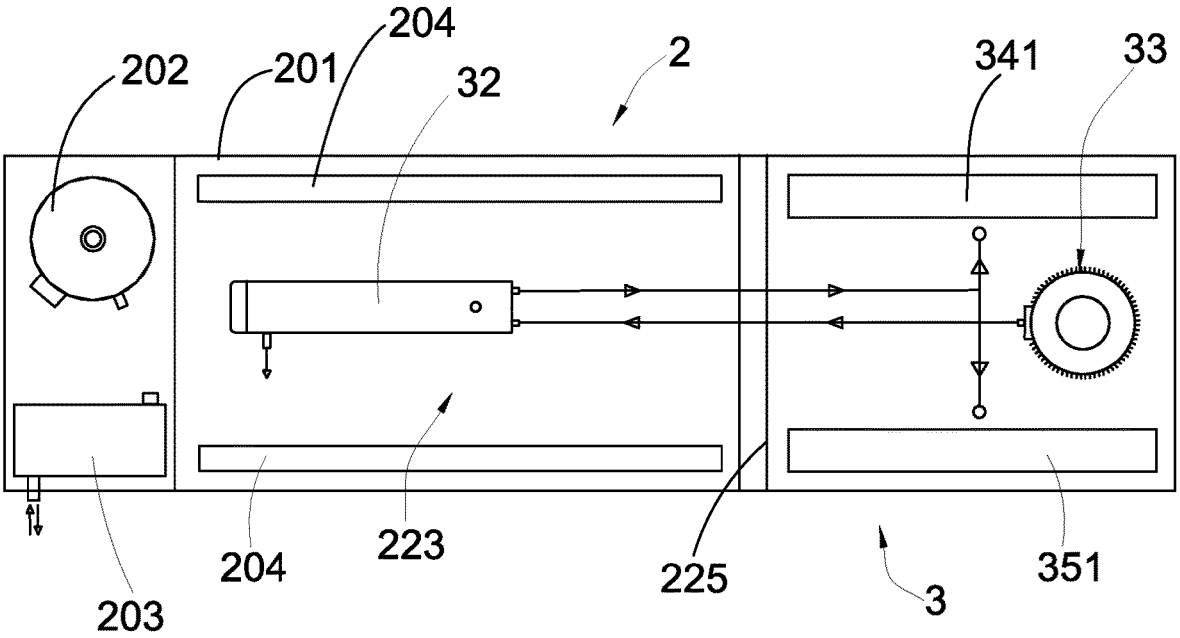
FIG. 7 is a schematic diagram of the central air conditioning and heat pump system according to the preferred embodiment of the present invention.
Figure 8:
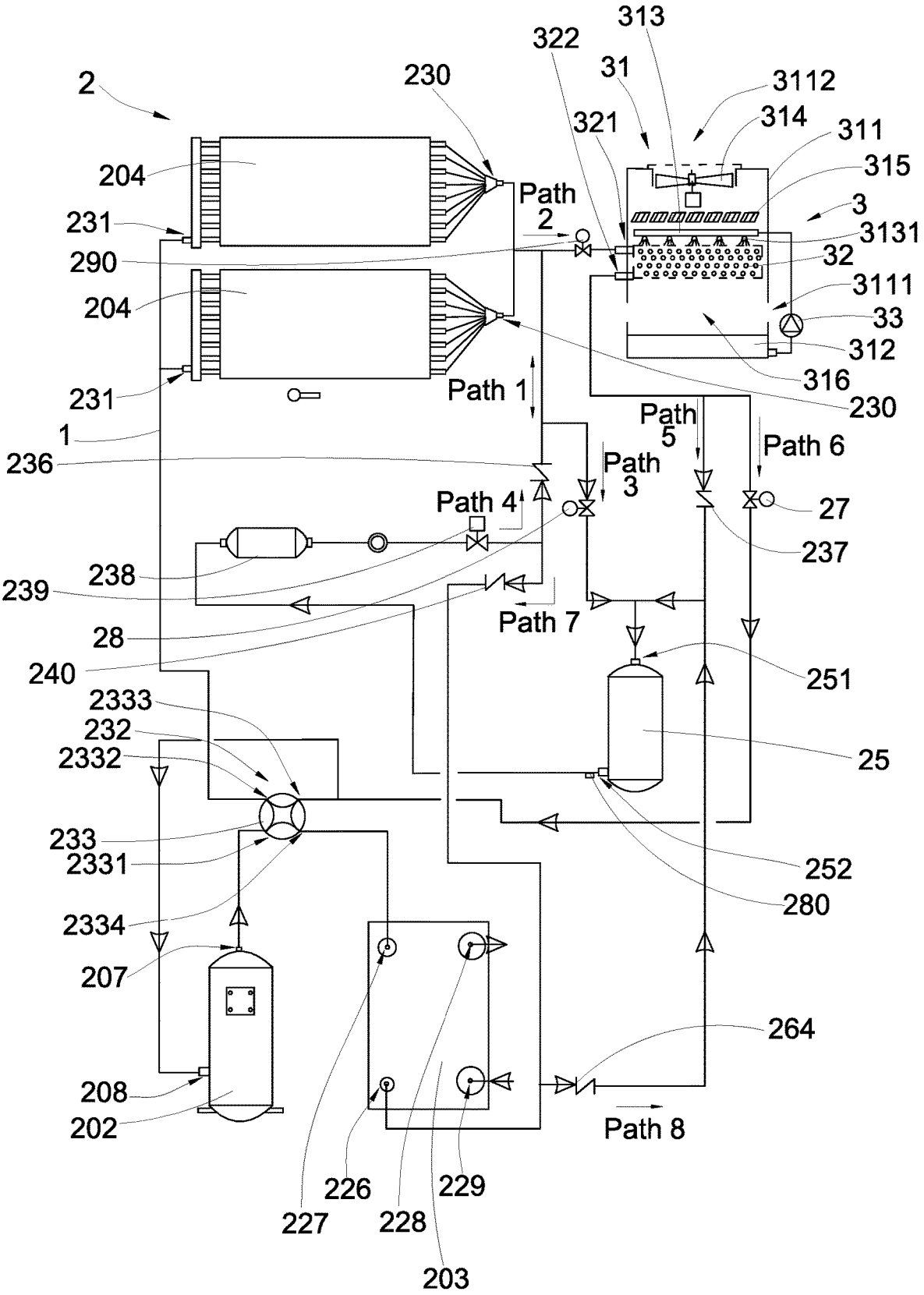
FIG. 8 is a schematic diagram of the central air conditioning and heat pump system according to the preferred embodiment of the present invention, illustrating a flow path of refrigerant.

Referring to FIG. 6 to FIG. 8 of the drawings, a central air conditioning and heat pump system according to a first preferred embodiment of the present invention is illustrated. Broadly, the central air conditioning and heat pump system may comprise a plurality of connecting pipes 1, a main heat exchange system 2, and a cooling arrangement 3. A predetermined amount of refrigerant may circulate through the various components (described below) of the main heat exchange system 2, while a predetermined amount of water may circulate through various components (described below) of the cooling arrangement 3. The refrigerant and the water may circulate through the various components through a plurality of connecting pipes 1.

The main heat exchange system 2 may comprise a main casing 201, a compressor 202, a first heat exchanger 203, a second heat exchanger 204. The cooling arrangement 3 may comprise a cooling tower 31, a cooling heat exchanger 32 supported in the cooling tower 31, and a pump 33 connected to the cooling tower 31.

The compressor 202 is supported in the main casing 201, and may have a compressor outlet 207 and a compressor inlet 208. The first heat exchanger 203 may be supported in the main casing 201 and connected to the compressor 202 through at least one of the connecting pipes 1. The second heat exchanger 204 may be supported in the main casing 201 and connected to the compressor 202 and the first heat exchanger 203 through at least one of the connecting pipes 1.

The cooling tower 31 of the cooling arrangement 3 may comprise a tower casing 311 having a cooling tower air inlet 3111 and a cooling tower air outlet 3112, a water storage tank 312 provided at a bottom portion of the tower casing 311 for storing a predetermined amount of cooling water, a water distributor 313, and a fan 314.

The water distributor 313 may be provided at an upper portion of the tower casing 311, and at a position underneath the fan 314. The water distributor 313 may comprise at least one water spraying head 3131 which may be arranged to spray water at a predetermined direction. In the preferred embodiment of the present invention, the water distributor 313 may be configured to spray water on the cooling heat exchanger 32. Accordingly, the cooling heat exchanger 32 may be provided in the tower casing 311 at a position underneath the water distributor 313.

The fan 314 may be provided in the tower casing 311 for drawing air to flow from the cooling tower air inlet 3111 to the cooling tower air outlet 3112. The cooling water collected in the water storage tank 312 may be arranged to be pumped back to the water distributor 313 for being reused. At the same time, a predetermined amount of air may be drawn from the cooling tower air inlet 3111 for performing heat exchange with the cooling water flowing through the cooling heat exchanger 32 for lowering a temperature of the cooling water so that the cooling water may be reused for another cooling cycle. The air having absorbed the heat from the cooling water may be discharged out of the tower casing 311 through the cooling tower air outlet 3112.

The central air conditioning and heat pump system may be selectively operated between a comprehensive air conditioning mode and a heat pump mode. In the comprehensive air conditioning mode, a predetermined amount of vaporous refrigerant is arranged to leave the compressor 202 and guided to enter the second heat exchanger 204 for releasing heat thereto. The refrigerant leaving the second heat exchanger 204 may be guided to flow into the cooling heat exchanger 32 for further releasing a predetermined amount of heat to the cooling water circulating in the cooling tower 31. The refrigerant leaving the cooling heat exchanger 32 may be guided to flow through the first heat exchanger 203 for absorbing heat from a heat distribution system connected to a designated indoor space. The refrigerant leaving the first heat exchanger 203 may be guided to flow back to the compressor 202 to complete an air conditioning cycle.

When the central air conditioning and heat pump system is in the heat pump mode, a predetermined amount of vaporous refrigerant may be arranged to leave the compressor 202 and guided to flow into the first heat exchanger 203 for releasing heat to the heat distribution system connected to a designated indoor space. The refrigerant leaving the first heat exchanger 203 may be guided to flow into the second heat exchanger 204 for absorbing heat from the ambient air. The refrigerant leaving the second heat exchanger 204 may be guided to flow back to the compressor 202 to complete a heat pump cycle.

According to the preferred embodiment of the present invention, the main casing 201 of the main heat exchange system 2 may be installed on the roof of a building. The central air conditioning and heat pump system of the present invention may be arranged to selectively provide air conditioning and heating to designated indoor spaces in the building. The main casing 201 may have an air cooling compartment 223. The tower casing 311 of the cooling tower 31 may be connected to the main casing 201. The main casing 201 and the tower casing 311 may be separated by a partition 225. As shown in FIG. 7 of the drawings, the compressor 202, the first heat exchanger 203, the second heat exchanger 204 may be supported in the air cooling compartment 223 of the main casing 201.

The compressor 202 may be configured to pressurize the refrigerant flowing therethrough. It forms a starting point of refrigerant circulation for a typical air conditioning cycle or a heat pump cycle.

The first heat exchanger 203 may have a first communicating port 226 and a second communicating port 227, and may be configured to perform heat exchange between the refrigerant and another working fluid such as water. The first heat exchanger 203 may be configured to act as an evaporator (i.e. converting the refrigerant into gaseous or vaporous state) when the central air conditioning and heat pump system is operated in the comprehensive air conditioning mode. In the preferred embodiment, the first heat exchanger 203 may be configured to allow heat exchange between the refrigerant and a heat distribution system so as to extract heat from a designated space. The heat so extracted is to be absorbed by the refrigerant which will be heated and turned into vaporous or gaseous state. The first communicating port 226 and the second communicating port 227 may form as an inlet or outlet for the refrigerant passing through the first heat exchanger 203.

Moreover, the first heat exchanger 203 may further have a third communicating port 228 and a fourth communicating port 229. The third communicating port 228 and the fourth communicating port 229 may be connected to the heat distribution system and serve as an inlet and an outlet for the refrigerant or water circulating through the heat distribution system respectively.

The first heat exchanger 203 may be configured to act as a condenser (i.e. converting the refrigerant into liquid state) when the air conditioning and heat pump system is operated in the heat pump mode. Thus, the first heat exchanger 203 may be configured to allow heat exchange between the refrigerant and the water or refrigerant flowing through the heat distribution system so as to extract heat from the refrigerant. The heat so extracted is to be absorbed and distributed by the heat distribution system.

The central air conditioning and heat pump system may comprise two second heat exchangers 204 connected in parallel. Each of the second heat exchanger 204 may have a first passage port 230 and a second passage port 231, and may be configured to perform heat exchange between the refrigerant and another working fluid such as air. The second heat exchangers 204 may be configured to act as a condenser (i.e. converting the refrigerant into liquid state) when the air conditioning and heat pump system is operated in the comprehensive air conditioning mode. In the preferred embodiment, the second heat exchangers 204 may be configured to allow heat exchange between the refrigerant and the ambient air drawn by a fan 24 so as to extract heat from the refrigerant. Each of the first passage ports 230 and the second passage ports 231 may form as an inlet or an outlet for the refrigerant passing through the corresponding second heat exchanger 204. The two second heat exchangers 204 may be structurally identical. The fan 24 may be supported by the main casing 201, as shown in FIG. 6 of the drawings.

The second heat exchanger 204 may be configured to act as an evaporator (i.e. converting the refrigerant into vaporous or gaseous state) when the air conditioning and heat pump system is operated in the heat pump mode. Thus, the second heat exchanger 204 may be configured to allow heat exchange between the refrigerant and the ambient air so as to absorb heat from the ambient air.

The main heat exchange system 2 may further comprise a refrigerant storage tank 25 having a liquid inlet 251 and a liquid outlet 252, wherein the refrigerant storage tank 25 may be connected to the first heat exchanger 203, the second heat exchangers 204, and the cooling arrangement 3. The refrigerant storage tank 25 may be configured to temporarily store refrigerant at a predetermined pressure.

It is important to note that the compressor 202, the first heat exchanger 203 and the second heat exchangers 204 of the main heat exchange system 2 and the cooling arrangement 3 may be arranged and connected through a plurality of connecting pipes 1 in certain configurations. An exemplary configuration is shown in FIG. 8 of the drawings.

The main heat exchange system 2 may further comprise a switching device 232 connecting between the first heat exchanger 203 and the second heat exchanger 204 for altering a flowing path of the refrigerant. Specifically, the switching device 232 may comprise a communicative valve 233 having first through fourth connecting port 2331, 2332, 2333, 2334. The communicative valve 233 may be switched between an air conditioning switching mode and a heat pump switching mode, wherein in the air conditioning switching mode, the communicative valve 233 is switched such that the first connecting port 2331 may be connected to the second connecting port 2332 so that refrigerant may flow from the first connecting port 2331 to the second connecting port 2332, while the third connecting port 2333 may be connected to the fourth connecting port 2334 so that refrigerant may flow from the third first connecting port 2333 to the fourth connecting port 2334.

In the heat pump switching mode, the communicative valve 233 may be switched so that the first connecting port 2331 may be connected to the fourth connecting port 2334 so that refrigerant may flow from the first connecting port 2331 to the fourth connecting port 2334, while the second connecting port 2332 may be connected to the third connecting port 2333, so that refrigerant may flow from the second connecting port 2332 to the third connecting port 2333.

As shown in FIG. 8 of the drawings, the first connecting port 2331 may be connected to the compressor outlet 207 of the compressor 202. The second connecting port 2332 may be connected to the second passage ports 231 of the second heat exchangers 204. The third connecting port 2333 may be connected to the cooling heat exchanger 32, the first heat exchanger 203, the refrigerant storage tank 25, and the second heat exchanger 204 through several auxiliary components (described below). The fourth connecting port 2334 may be connected to the second communicating port 227 of the first heat exchanger 203.

The cooling heat exchanger 32 may have a cooling inlet 321 and a cooling outlet 322. Refrigerant may be guided to flow into the cooling heat exchanger 32 through the cooling inlet 321, and flow out of the cooling heat exchanger 32 through the cooling outlet 322. The second heat exchangers 204 may be connected to the cooling heat exchanger 32, the first heat exchanger 203, and the refrigerant storage tank 25 through several other components. For the sake of clarity, the refrigerant passing through the first passage ports 230 may either flow through or come from Path 1, or flow to Path 2 as shown in FIG. 8. Path 2 may connect the first passage ports 230 to the cooling inlet 321 of the cooling heat exchanger 32, so that refrigerant leaving the first passage ports 230 may be guided to flow toward the cooling inlet 321 of the cooling heat exchanger 32 through Path 2.

Path 1 may be bifurcated into Path 3 and Path 4. The refrigerant flowing from the first passage ports 230 may enter Path 1 and may be directed to Path 3 shown in FIG. 8 of the drawings. Path 3 may direct refrigerant to flow into the refrigerant storage tank 25 through the liquid inlet 251. Path 4 may connect Path 1 to the liquid outlet 252 of the refrigerant storage tank 25, so that refrigerant coming from the liquid outlet 252 may flow through Path 4 and reach Path 1.

The main heat exchange system 2 may further comprise a first unidirectional valve 236 connected between the first passage ports 230 of the second heat exchangers 204 and the first communicating port 226 of the first heat exchanger 203. Specifically, the first unidirectional valve 236 may be connected in Path 4 and may be configured to restrict the flow of refrigerant in one predetermined direction. In this preferred embodiment, the first unidirectional valve 236 may be configured to allow refrigerant to flow only in a direction from the liquid outlet 252 of the refrigerant storage tank 25 toward the first passage ports 230 of the second heat exchangers 204 through Path 4 and Path 1.

The main heat exchange system 2 may further comprise a filter 238 connected to the liquid outlet 252 of the refrigerant storage tank 25 in Path 4. The filter 238 may be configured to filter unwanted substances from the refrigerant which pass through them. The refrigerant coming out from the liquid outlet 252 may sequentially pass through the filter 238 in Path 4 and Path 1 and eventually reach the first passage ports 230 of the second heat exchangers 204.

The main heat exchange system 2 may further comprise an expansion valve 239 connected to the filter 238 in Path 4. The expansion valve 239 may be configured to control and regulate the flow of the refrigerant passing through them. Thus, the refrigerant passing through Path 4 may be guided to flow through the filter 238 and the expansion valve 239.

On the other hand, refrigerant coming out from the cooling outlet 322 of the cooling heat exchanger 32 may enter either Path 5 or Path 6. This may be illustrated in FIG. 8 of the drawings. The main heat exchange system 2 may further comprise a second unidirectional valve 237 connected to the cooling outlet 322 and the liquid inlet 251 of the refrigerant storage tank 25 in Path 5. The second unidirectional valve 237 may be configured to allow flow of refrigerant only in a direction from the cooling outlet 322 toward the liquid inlet 251 through Path 5.

The main heat exchange system 2 may further comprise a first electrically-operated two-way valve 27 connected to the cooling outlet 322 and the third connecting port 2333 in Path 6. The first electrically-operated two-way valve 27 may be selectively opened or closed to selectively allow refrigerant to pass therethrough. Refrigerant from the cooling outlet 322 may be selectively guided to flow through the first electrically-operated two-way valve 27 in Path 6.

The main heat exchange system 2 may further comprise a second electrically- operated two-way valve 28 connected to the first passage ports 230 of the second heat exchangers 204 and the liquid inlet 251 of the refrigerant storage tank 25 in Path 3. The second electrically-operated two-way valve 28 may be selectively opened or closed to selectively allow refrigerant to pass therethrough. Refrigerant from the first passage ports 230 may be selectively guided to flow through second electrically-operated two-way valve 28 and enter the liquid inlet 251 of the refrigerant storage tank 25 through Path 3.

The main heat exchange system 2 may further comprise a third electrically-operated two-way valve 290 connected between the first passage ports 230 and the cooling inlet 321 of the cooling heat exchanger 32 in Path 2. The third electrically-operated two-way valve 290 may be selectively opened or closed to selectively allow refrigerant to pass therethrough.

The main heat exchange system 2 may further comprise a third unidirectional valve 240 connected to the expansion valve 239, the first unidirectional valve 236 and the first communicating port 226 of the first heat exchanger 203 through Path 7 as indicated in FIG. 8 of the drawings. The third unidirectional valve 240 may be configured to allow refrigerant to flow only in a direction from the expansion valve 239 in Path 4 toward the first communicating port 226 through Path 7.

The main heat exchange system 2 may further comprise a fourth unidirectional valve 264 connected to the first communicating port 226 of the first heat exchanger 203, and the liquid inlet 251 of the refrigerant storage tank 25 through Path 8 indicated in FIG. 8 of the drawings. The fourth unidirectional valve 264 may be configured to allow refrigerant to flow in a direction from the first communicating port 226 toward the liquid inlet 251 through Path 8. The fourth unidirectional valve 264 may also be connected to the third unidirectional valve 240 in Path 7, and the second unidirectional valve 237 in Path 5 which may connect to the cooling outlet 322, and the first electrically-operated two-way valve 27 in parallel.

The heat distribution system may be arranged to retrieve the heat generated by the main heat exchange system 2 and distribute the heat to designated indoor spaces through at least one terminal device. One of such terminal devices may be a ventilating device. The ventilating device may be utilized for delivering ambient air to the indoor space when the central air conditioning and heat pump system is operated in the heat pump mode.

According to the preferred embodiment of the present invention, the cooling tower 31 may be installed to lower the temperature of refrigerant circulating in the cooling heat exchanger 32.

The tower casing 311 may have a rectangular cross section having a top side 3113, a bottom side and a plurality of peripheral sides 3114. Obviously, the tower casing 311 may be embodied as having a wide variety of cross sections for suiting different operational environments.

The pump 33 may be connected between the water storage tank 312 and the water distributor 313 for circulating cooling water between the water storage tank 312 and the water distributor 313.

As shown in FIG. 8 of the drawings, the tower casing 311 may further comprise a water screening member 315 provided above the water distributor 313 for preventing water from accidentally reaching the fan 314. The water screening member 315 may also be arranged to guide or reflect water to flow toward the cooling heat exchanger 32 so as to ensure enough water is supplied to the cooling heat exchanger 32 for performing heat exchange with the refrigerant flowing therein.

The main heat exchange system 2 may further comprise a temperature sensor 280 provided at the liquid outlet 252 of the refrigerant storage tank 25 for detecting a temperature of the refrigerant flowing through the liquid outlet 252. The operation mode of the present invention may depend on the temperature detected by the temperature sensor 280.

The operation of the present invention is as follows: the central air conditioning and heat pump system described above involves a refrigerant flowing cycle and a water flowing cycle. The refrigerant may flow through the various components of the main heat exchange system 2 while the water may flow through the various components of the cooling arrangement 3.

When the central air conditioning and heat pump system is in the comprehensive air conditioning mode, it is configured to generate cool air to designated indoor spaces. A refrigerant cycle starts from the compressor 202. Superheated or vaporous refrigerant may be arranged to leave the compressor 202 through the compressor outlet 207. The communicative valve 233 may be switched to the air conditioning switching mode. Moreover, the third electrically-operated two-way valve 290 may be opened, while the first electrically-operated two-way valve 27 and the second electrically-operated two-way valve 28 may be closed. The refrigerant leaving the compressor 202 may pass through the first connecting port 2331 of the communicative valve 233, the second connecting port 2332, and enter the second heat exchangers 204 through the second passage ports 231. The refrigerant may then perform heat exchange with a coolant such as ambient air so as to release heat to ambient air (air-cooled).

The refrigerant may then be guided to exit the second heat exchangers 204 through the first passage ports 230. The refrigerant leaving the second heat exchangers 204 may then be guided to flow through the third electrically-operated two-way valve 290 in Path 2 and enter the cooling heat exchanger 32 through the cooling inlet 321. The refrigerant may be prevented from entering path 1 by the second electrically-operated two-way valve 28 and the first unidirectional valve 236 at this time. The refrigerant may be arranged to further release heat to the cooling water circulating in the cooling tower 31. The heat released to the cooling water may be carried away by the ambient air drawn from the cooling tower air inlet 3111.

The refrigerant leaving the cooling heat exchanger 32 through the cooling outlet 322 may then be guided to pass the second unidirectional valve 237 in Path 5 and pass through the liquid inlet 251 and enter the refrigerant storage tank 25. The refrigerant may then leave the refrigerant storage tank 25 through the liquid outlet 252 and pass through the filter 238, the expansion valve 239 in Path 4 and the third unidirectional valve 240 in Path 7 and eventually enter the first heat exchanger 203 through the first communicating port 226. The refrigerant entering the first heat exchanger 203 may then be arranged to perform heat exchange with another heat exchange medium circulating in the heat distribution system so as to absorb heat from therefrom. The refrigerant may then be guided to leave the first heat exchanger 203 through the second communicating port 227. The refrigerant may then be guided to flow through the fourth connecting port 2334 and the third connecting port 2333 of the communicative valve 233 and eventually flow back to the compressor 202 through the compressor inlet 208. This completes one refrigerant cycle for the comprehensive air conditioning mode.

It is worth mentioning that the cooling heat exchanger 32 may be utilized for further cooling the temperature of the refrigerant through heat exchange with the cooling water coming from the water distributor 313. The pump 33 may pump cooling water to circulate between the water distributor 313 and the water storage tank 312. Specifically, cooling water in the water storage tank 312 may be pumped to the water distributor 313 for spraying on the cooling heat exchanger 32. The cooing water may then perform heat exchange with the refrigerant circulating in the cooling heat exchanger 32. After that, the cooling water having absorbed heat from the refrigerant may enter a cooling zone 316 as a space formed between the cooling heat exchanger 32 and the water storage tank 312 so that ambient air drawn from the cooling tower air inlet 3111 may be able to perform heat exchange with the cooling water. The cooling water will then be cooled down and collected in the water storage tank 312 for performing another cooling cycle.

From the above descriptions, one skilled in the art may appreciate that the refrigerant circulating in the main heat exchange system 2 of the present invention may be cooled by either the second heat exchangers 204, the cooling heat exchanger 32, or both. In the event that water supply is interrupted, the fan 314 and the pump 33 may be turned off so that the refrigerant will only be cooled by the second heat exchangers 204.

Note that the comprehensive air conditioning mode implies that the refrigerant circulating in the main heat exchange system 2 may be cooled by water (cooling tower 31) as well as air (second heat exchangers 204).

When the temperature detected by the temperature sensor 280 falls below a predetermined threshold, the refrigerant may only be cooled by the second heat exchangers 204. This mode of operation may be referred to as air-cooled air conditioning mode. When the central air conditioning and heat pump system is in the air-cooled air conditioning mode, it is also configured to generate cool air to designated indoor spaces. A refrigerant cycle starts from the compressor 202. Superheated or vaporous refrigerant may be arranged to leave the compressor 202 through the compressor outlet 207. The communicative valve 233 may be switched to the air conditioning switching mode. Moreover, the third electrically-operated two-way valve 290 may be closed, the first electrically-operated two-way valve 27 may be closed and the second electrically-operated two-way valve 28 may be opened. The refrigerant leaving the compressor 202 may pass through the first connecting port 2331 of the communicative valve 233, the second connecting port 2332, and enter the second heat exchangers 204 through the second passage ports 231. The refrigerant may then perform heat exchange with a coolant such as ambient air so as to release heat to ambient air.

The refrigerant may then be guided to exit the second heat exchangers 204 through the first passage ports 230. The refrigerant leaving the second heat exchangers 204 may then be guided to flow through Path 1 and enter Path 3 and flow through the first electrically-operated two-way valve 28. The refrigerant may be prevented from entering the cooling heat exchanger 32 at this time because the third electrically-operated two-way valve 290 is closed.

The refrigerant pass through the second electrically-operated two-way valve 28 may be arranged to pass through the liquid inlet 251 and enter the refrigerant storage tank 25. The refrigerant may then leave the refrigerant storage tank 25 through the liquid outlet 252 and pass through the filter 238, the expansion valve 239 in Path 4 and the third unidirectional valve 240 in Path 7 and eventually enter the first heat exchanger 203 through the first communicating port 226. The refrigerant entering the first heat exchanger 203 may then be arranged to perform heat exchange with another heat exchange medium circulating in the heat distribution system so as to absorb heat from therefrom. The refrigerant may then be guided to leave the first heat exchanger 203 through the second communicating port 227. The refrigerant may then be guided to flow through the fourth connecting port 2334 and the third connecting port 2333 of the communicative valve 233 and eventually flow back to the compressor 202 through the compressor inlet 208. This completes one refrigerant cycle for the air-cooled air conditioning mode. In this refrigerant cycle, the refrigerant may be solely cooled by the ambient air passing through the second heat exchangers 204.

When the central air conditioning and heat pump system is in the heat pump mode, it is configured to generate heat to designated indoor spaces. The corresponding refrigerant cycle also starts from the compressor 202. Superheated or vaporous refrigerant may be arranged to leave the compressor 202 through the compressor outlet 207. The communicative valve 233 may be switched to heat pump switching mode. Moreover, the first through third electrically-operated two-way valve 27, 28, 290 may all be closed.

The refrigerant leaving the compressor 202 may pass through the first connecting port 2331, the fourth connecting port 2334, and enter the first heat exchanger 203 through the second communicating port 227. The refrigerant may then perform heat exchange with the heat distribution system so as to release heat to the heat exchange medium circulating in the first heat exchanger 203. The refrigerant may be converted into liquid state after releasing heat. The refrigerant may then be guided to exit the first heat exchanger 203 through the first communicating port 226. The refrigerant leaving the first heat exchanger 203 may then be guided to flow through the fourth unidirectional valve 240 in Path 8 and pass through the liquid inlet 251 and enter the refrigerant storage tank 25. Refrigerant may be prevented from reaching the cooling heat exchanger 32 because of the second unidirectional valve 237.

When the central air conditioning and heat pump system is in the heat pump mode, the fan 314 and the pump 33 may be turned off. In addition, the cooling water may be discharged out of the cooling tower 31. The refrigerant will then be guided to leave the refrigerant storage tank 25 through the liquid outlet 252 and pass through the filter 238, the expansion valve 239 connected in Path 4, and may be guided to pass through the first unidirectional valve 236. The refrigerant may then be guided to reach the second heat exchangers 204 through the corresponding first passage ports 230 for absorbing heat from the ambient air. The refrigerant may then exit the second heat exchangers 204 through the second passage ports 231 and may be guided to flow through the second connecting port 2332 of the communicative valve 233, the third connecting port 2333, and eventually go back to the compressor 202 through the compressor inlet 208. This completes one refrigerant cycle in the heat pump mode.

The central air conditioning and heat pump system may further operate in a defrosting mode. The defrosting mode may be utilized to remove frost which may be formed on the second heat exchanger 204 when the central air conditioning and heat pump system is operated in the heat pump mode. In the defrosting mode, the corresponding refrigerant cycle also starts from the compressor 202. Superheated or vaporous refrigerant may be arranged to leave the compressor 202 through the compressor outlet 207. The communicative valve 233 may be switched to the air conditioning switching mode. Moreover, the first and the third electrically-operated two-way valve 27, 290 may be closed, while the second electrically-operated two-way valve 28 may be opened.

The refrigerant leaving the compressor 202 may pass through the first connecting port 2331, the second connecting port 2332, and enter the second heat exchangers 204 through the second passage ports 231 for releasing heat to defrost the second heat exchangers 204. The refrigerant may exit the second heat exchangers 204 through the first passage ports 230 and may be guided to pass through the second electrically-operated two-way valve 28 in Path 3 and enter the refrigerant storage tank 25 through the liquid inlet 251. The refrigerant may then leave the refrigerant storage tank 25 through the liquid outlet 252 and pass through the filter 238 and the expansion valve 239 connected in Path 4. The refrigerant may then be guided to pass through the third unidirectional valve 240 in Path 7 and enter the first heat exchanger 203 through the first communicating port 226. The refrigerant leaving the first heat exchanger 203 through the second communicating port 227 may then be guided to flow through the fourth connecting port 2334 of the communicative valve 233, the third connecting port 2333, and eventually go back to the compressor 202 through the compressor inlet 208. This completes one refrigerant cycle in the defrosting mode.

The present invention, while illustrated and described in terms of the preferred embodiments and several alternatives, is not limited to the particular description contained in this specification. Additional alternative or equivalent components could also be used to practice the present invention.

What is claimed is:

1. A central air conditioning and heat pump system for a heat distribution system, comprising:

a plurality of connecting pipes;

a main heat exchange system, which comprises:

a compressor having a compressor outlet and a compressor inlet;

a first heat exchanger connected to said compressor through at least one of said connecting pipes, said first heat exchanger having a first communicating port and a second communicating port; and a second heat exchanger connected to said compressor and said first heat exchanger through at least one of said connecting pipes, said second heat exchanger having a first passage port and a second passage port;

a refrigerant storage tank having a liquid inlet and a liquid outlet; and a cooling arrangement, which comprises:

a cooling tower, which comprises:

a tower casing having a cooling tower air inlet and a cooling tower air outlet;

a fan provided in a vicinity of said cooling tower air outlet;

a water storage tank provided in said tower casing for storing cooling water;

a water distributor provided in said tower casing and connected to said water storage tank through at least one of said connecting pipes, said water distributor comprising at least one spraying head arranged to spray water at a predetermined direction, a pump connected between said water storage tank and said water distributor so that said cooling water in said water storage tank is arranged to be pumped to said water distributor through said pump; and a cooling heat exchanger provided in said tower casing and connected to said second heat exchanger, said first heat exchanger, and said refrigerant storage tank through at least one of said connecting pipes, said cooling heat exchanger having a cooling inlet and a cooling outlet, said water distributor being arranged to spray said cooling water on said cooling heat exchanger so that refrigerant passing through said cooling heat exchanger is allowed to perform heat exchange with said cooling water;

said air conditioning and heat pump system being selectively operated between a comprehensive air conditioning mode and a heat pump mode, wherein in said comprehensive air conditioning mode, vaporous refrigerant is arranged to leave said compressor and guided to enter said second heat exchanger for releasing heat thereto, said refrigerant leaving said second heat exchanger being guided to flow into said cooling heat exchanger for further releasing heat to said water circulating in said cooling arrangement, said refrigerant leaving said cooling heat exchanger being guided to flow through said first heat exchanger for absorbing heat from said heat distribution system, said refrigerant leaving said first heat exchanger being guided to flow back to said compressor to complete an air conditioning cycle, wherein in said heat pump mode, vaporous refrigerant is arranged to leave said compressor and guided to flow into said first heat exchanger for releasing heat to said heat distribution system, said refrigerant leaving said first heat exchanger being guided to flow into said refrigerant storage tank for being temporarily stored, said refrigerant leaving said refrigerant storage tank being guided to flow to said second heat exchanger for absorbing heat from ambient air, said refrigerant leaving said second heat exchanger being guided to flow back to said compressor to complete a heat pump cycle.

2. The central air conditioning and heat pump system, as recited in claim 1, wherein said main heat exchange system further comprises a switching device connecting between said first heat exchanger and said second heat exchanger, said switching device comprises a communicative valve having first through fourth connecting port, said communicative valve being configured to be switched between an air conditioning switching mode and a heat pump switching mode, wherein in said air conditioning switching mode, said communicative valve is switched such that said first connecting port is connected to said second connecting port, while said third connecting port is connected to said fourth connecting port, wherein in said heat pump switching mode, said communicative valve is switched so that said first connecting port is connected to said fourth connecting port, while said second connecting port is connected to said third connecting port.

3. The central air conditioning and heat pump system, as recited in claim 2, wherein said first connecting port is connected to said compressor outlet of said compressor, said second connecting port being connected to said second passage port of said second heat exchanger, said third connecting port being connected to said cooling heat exchanger, said first heat exchanger, said refrigerant storage tank, and said second heat exchanger, said fourth connecting port being connected to said second communicating port of said first heat exchanger.

4. The central air conditioning and heat pump system, as recited in claim 3, wherein said main heat exchange system further comprises a first unidirectional valve connected to said first passage port of said second heat exchanger, and said liquid outlet of said refrigerant storage tank, said first unidirectional valve being configured to restrict a flow of refrigerant only in a direction from said liquid outlet of said refrigerant storage tank toward said first passage port of said second heat exchanger.

5. The central air conditioning and heat pump system, as recited in claim 4, wherein said main heat exchange system further comprises a second unidirectional valve connected to said cooling outlet of said cooling heat exchanger, said liquid inlet of said refrigerant storage tank, said second unidirectional valve being configured to allow flow of said refrigerant only in a direction from said cooling outlet of said cooling heat exchanger toward said liquid inlet of said refrigerant storage tank.

6. The central air conditioning and heat pump system, as recited in claim 5, wherein said main heat exchange system further comprises a first electrically-operated two-way valve connected to said cooling outlet of the cooling heat exchanger and said third connecting port of said communicative valve, said first electrically-operated two-way valve being selectively opened and closed to selectively allow refrigerant to pass therethrough.

7. The central air conditioning and heat pump system, as recited in claim 6, wherein said main heat exchange system further comprises a second electrically-operated two-way valve connected to said first passage port of said second heat exchanger and said liquid inlet of said refrigerant storage tank, said second electrically-operated two-way valve being selectively opened and closed to selectively allow refrigerant to pass therethrough.

8. The central air conditioning and heat pump system, as recited in claim 7, wherein said main heat exchange system further comprises a third electrically-operated two-way valve connected between said first passage port of said second heat exchanger and said cooling inlet of said cooling heat exchanger, said third electrically-operated two-way valve being selectively opened and closed to selectively allow refrigerant to pass therethrough.

9. The central air conditioning and heat pump system, as recited in claim 8, wherein said main heat exchange system further comprises a third unidirectional valve connected to said liquid outlet of said refrigerant storage tank, and said first communicating port of said first heat exchanger, said third unidirectional valve being configured to allow refrigerant to flow only in a direction from said liquid outlet of said refrigerant storage tank toward said first communicating port.

10. The central air conditioning and heat pump system, as recited in claim 9, wherein said main heat exchange system further comprises a fourth unidirectional valve connected to said first communicating port of said first heat exchanger, and said liquid inlet of said refrigerant storage tank, said fourth unidirectional valve being configured to allow refrigerant to flow only in a direction from said first communicating port toward said liquid inlet.

11. The central air conditioning and heat pump system, as recited in claim 10, wherein said tower casing further comprises a water screening member provided above said water distributor for preventing water from accidentally reaching said fan.

12. The central air conditioning and heat pump system, as recited in claim 11, wherein said main heat exchange system further comprise a temperature sensor provided at said liquid outlet of said refrigerant storage tank for detecting a temperature of said refrigerant flowing through said liquid outlet.

13. The central air conditioning and heat pump system, as recited in claim 12, wherein when said central air conditioning and heat pump system is in said comprehensive air conditioning mode, said communicative valve is switched to said air conditioning switching mode, said third electrically-operated two-way valve is opened, while said first electrically-operated two-way valve and said second electrically-operated two-way valve are closed, said refrigerant being guided to sequentially pass through said compressor outlet of said compressor, said first connecting port, said second connecting port, said second passage port of said second heat exchangers, said first passage port of said second heat exchanger, said third electrically-operated two-way valve, said cooling inlet of said cooling heat exchanger, said cooling outlet of said cooling heat exchanger, said second unidirectional valve, said liquid inlet of said refrigerant storage tank, said liquid outlet of said refrigerant storage tank, said third unidirectional valve, said first communicating port of said first heat exchanger, said second communicating port of said first heat exchanger, said fourth connecting port, said third connecting port, and back to said compressor through said compressor inlet.

14. The central air conditioning and heat pump system, as recited in claim 12, being selectively operated in an air-cooled air conditioning mode, wherein in said air-cooled air conditioning mode, said vaporous refrigerant is arranged to leave said compressor and guided to enter said second heat exchanger for releasing heat thereto, said refrigerant leaving said second heat exchanger being guided to flow into said first heat exchanger for absorbing heat from said heat distribution system, said refrigerant leaving said first heat exchanger being guided to flow back to said compressor to complete an air-cooled air conditioning cycle.

15. The central air conditioning and heat pump system, as recited in claim 12, wherein when said central air conditioning and heat pump system is in said air-cooled air conditioning mode, said communicative valve is switched to said air conditioning switching mode, said third electrically-operated two-way valve is closed, said first electrically-operated two-way valve is closed and said second electrically-operated two-way valve is opened, said refrigerant being guided to sequentially pass through said compressor outlet of said compressor, said first connecting port, said second connecting port, said second passage port of said second heat exchanger, said first passage port of said second heat exchangers, said second electrically-operated two-way valve, said liquid inlet of said refrigerant storage tank, said liquid outlet of said refrigerant storage tank, said third unidirectional valve, said first communicating port of said first heat exchanger, said second communicating port of said first heat exchanger, said fourth connecting port, said third connecting port, and back to said compressor through said compressor inlet.

16. The central air conditioning and heat pump system, as recited in claim 12, wherein when said central air conditioning and heat pump system is in said heat pump mode, said communicative valve is switched to said heat pump switching mode, and said first through third electrically-operated two-way valve are closed, said refrigerant being guided to sequentially pass through said compressor outlet of said compressor, said first connecting port, said fourth connecting port, said second communicating port of said first heat exchanger, said first communicating port of said first heat exchanger, said fourth unidirectional valve, said liquid inlet of said refrigerant storage tank, said liquid outlet of said refrigerant storage tank, said first unidirectional valve, said first passage port of said second heat exchanger, said second passage port of said second heat exchanger, said second connecting port, said third connecting port, and back to said compressor through said compressor inlet.

17. The central air conditioning and heat pump system, as recited in claim 12, being selectively operated in a defrosting mode, wherein when said central air conditioning and heat pump system is in said defrosting mode, said communicative valve is switched to said air conditioning switching mode, said first electrically-operated two-way valve and said third electrically-operated two-way valve are closed, while said second electrically-operated two-way valve is opened, said refrigerant being guided to sequentially pass through said compressor outlet of said compressor, said first connecting port, said second connecting port, said second passage port of said second heat exchanger, said first passage port of said second heat exchanger, said second electrically-operated two-way valve, said liquid inlet of said refrigerant storage tank, said liquid outlet of said refrigerant storage tank, said third unidirectional valve, said first communicating port of said first heat exchanger, said second communicating port of said first heat exchanger, said fourth connecting port, said third connecting port, and back to said compressor through said compressor inlet.

* * * * *